US009128428B2

(12) United States Patent
Morinaga et al.

(10) Patent No.: US 9,128,428 B2
(45) Date of Patent: Sep. 8, 2015

(54) IMAGE FORMING APPARATUS WHICH INCLUDES A COLORLESS TONER IMAGE FORMING DEVICE

(71) Applicants: Mutsuki Morinaga, Kanagawa (JP); Tadashi Kasai, Kanagawa (JP); Masato Iio, Kanagawa (JP); Makoto Yasuda, Kanagawa (JP); Yuichi Aizawa, Ibaraki (JP); Hitoshi Yamamoto, Kanagawa (JP)

(72) Inventors: Mutsuki Morinaga, Kanagawa (JP); Tadashi Kasai, Kanagawa (JP); Masato Iio, Kanagawa (JP); Makoto Yasuda, Kanagawa (JP); Yuichi Aizawa, Ibaraki (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/314,634

(22) Filed: Jun. 25, 2014

(65) Prior Publication Data

US 2015/0010337 A1 Jan. 8, 2015

(30) Foreign Application Priority Data

Jul. 8, 2013 (JP) ..... 2013-142307

(51) Int. Cl.

| | |
|---|---|
| ***G03G 15/20*** | (2006.01) |
| ***G03G 15/00*** | (2006.01) |
| *G03G 21/20* | (2006.01) |

(52) U.S. Cl.

CPC ..... *G03G 15/2017* (2013.01); *G03G 15/2021* (2013.01); *G03G 15/6585* (2013.01); *G03G 21/206* (2013.01); *G03G 2215/0129* (2013.01); *G03G 2215/2032* (2013.01)

(58) Field of Classification Search

CPC ..... G03G 15/2021; G03G 15/6585; G03G 2215/00426

USPC ..... 399/341

See application file for complete search history.

(56) References Cited

U.S. PATENT DOCUMENTS

| | | | | |
|---|---|---|---|---|
| 8,521,053 | B2 * | 8/2013 | Iijima et al. | 399/341 |
| 8,725,026 | B2 * | 5/2014 | Ikeda et al. | 399/341 |
| 8,929,794 | B2 * | 1/2015 | Hatazaki | 399/341 |
| 2012/0107004 | A1 | 5/2012 | Sonohara et al. | |
| 2013/0101303 | A1 | 4/2013 | Kasai et al. | |

FOREIGN PATENT DOCUMENTS

| | | |
|---|---|---|
| JP | 4-260065 | 9/1992 |
| JP | 2005-250335 | 9/2005 |
| JP | 2011-197051 | 10/2011 |

* cited by examiner

*Primary Examiner* — William J Royer

(74) *Attorney, Agent, or Firm* — Oblon, McClelland, Maier & Neustadt, L.L.P.

(57) ABSTRACT

An image forming apparatus includes a color toner image forming device, a fixing device, a cooling device, a colorless toner image forming device, and a control device. The color toner image forming device forms a toner image on a recording medium with a color toner. The fixing device heats the toner image on the recording medium to fix the toner image on the recording medium. The cooling device cools the fixed toner image. The colorless toner image forming device forms a toner image on the recording medium with a colorless toner having a storage elastic modulus of 100 or less and a loss tangent of 10 or greater at a heating temperature of the fixing device. The control device controls cooling power of the cooling device based on whether or not the colorless toner image forming device forms the toner image.

12 Claims, 8 Drawing Sheets

IMAGE FORMING APPARATUS WHICH INCLUDES A COLORLESS TONER IMAGE FORMING DEVICE

CROSS-REFERENCE TO RELATED APPLICATION

This patent application is based on and claims priority pursuant to 35 U.S.C. §119(a) to Japanese Patent Application No. 2013-142307, filed on Jul. 8, 2013, in the Japan Patent Office, the entire disclosure of which is hereby incorporated by reference herein.

BACKGROUND

1. Technical Field

Embodiments of this disclosure relate to an image forming apparatus, such as a copier, a printer, or a facsimile machine, equipped with a heat fixing device.

2. Related Art

In a typical electrophotographic image forming apparatus equipped with a heat fixing device, a toner image formed on a recording medium is subjected to heat and pressure via a fixing member to cause fusion or swelling in at least a part of a resin component of toner forming the toner image, thereby fixing the toner image on the recording medium. The heat fixing device is capable of providing a high fixed image quality at a high fixing speed, and thus is preferably used.

The image forming apparatus may include a cooling device that cools the toner on the recording medium heated by the heat fixing device.

In a commonly used image forming apparatus, toner images formed with toners of multiple colors, such as yellow, magenta, cyan, and black, (hereinafter referred to as process color toners) are superimposed on a recording medium and fixed thereon by a fixing device to obtain a color image.

With increasingly diversified image qualities in recent years, some image forming apparatuses employ a toner other than the process color toners to obtain high value-added prints unobtainable with normal process color toners. An example of the toner other than the process color toners is a colorless clear toner (also referred to as transparent toner, colorless toner, achromatic toner, or pigmentless toner). For example, some image forming apparatuses apply a high gloss clear toner over the entirety or a desired part of a color image print and fix the high gloss clear toner thereon with a fixing device, to thereby provide gloss to the entirety or the desired part of the print.

SUMMARY

In one embodiment of this disclosure, there is provided an improved image forming apparatus that, in one example, includes a color toner image forming device, a fixing device, a cooling device, a colorless toner image forming device, and a control device. The color toner image forming device forms a toner image on a recording medium with a color toner. The fixing device heats the toner image on the recording medium to fix the toner image on the recording medium. The cooling device cools the fixed toner image. The colorless toner image forming device forms a toner image on the recording medium with a colorless toner having a storage elastic modulus of 100 or less and a loss tangent of 10 or greater at a heating temperature of the fixing device. The control device controls cooling power of the cooling device based on whether or not the colorless toner image forming device forms the toner image.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1:
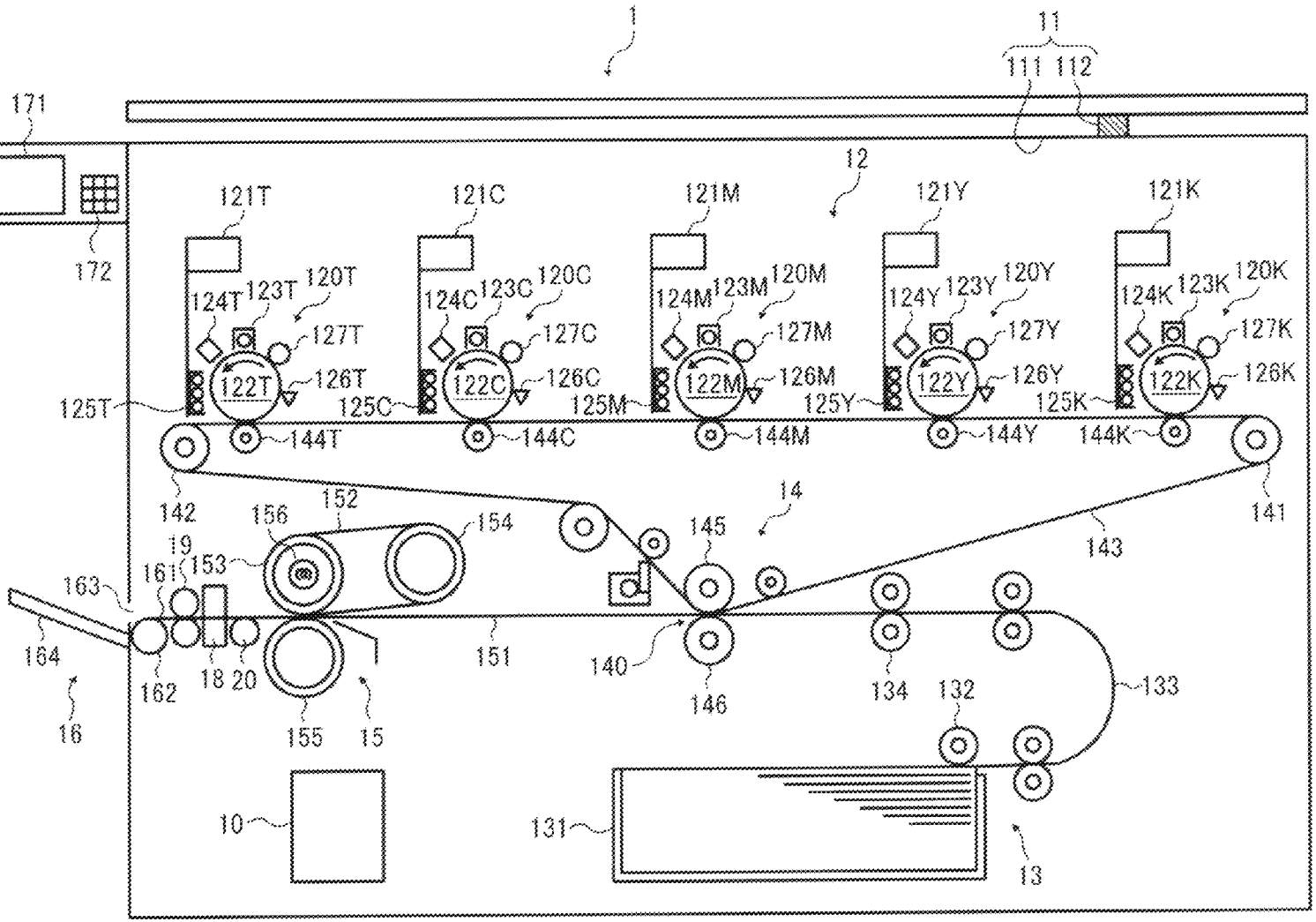
FIG. 1 is a diagram illustrating an overall configuration of an image forming apparatus according to an embodiment of this disclosure.

In describing the embodiments illustrated in the drawings, specific terminology is adopted for the purpose of clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, an image forming apparatus according to an embodiment of this disclosure will be described.

Figure 2:
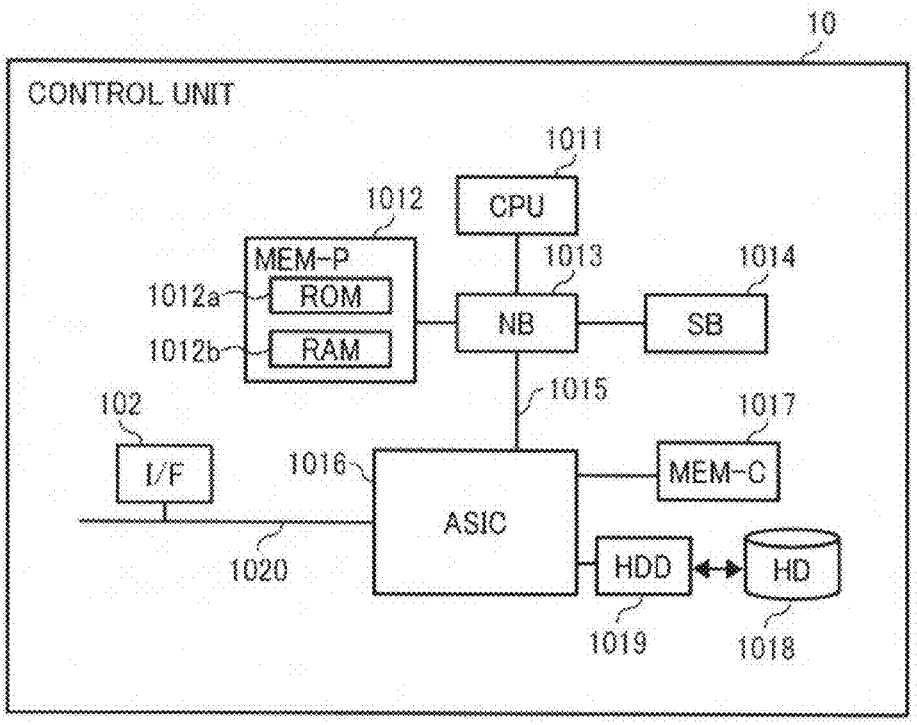
FIG. 2 is a diagram illustrating a schematic configuration of a control unit of the image forming apparatus according to the embodiment.

FIG. 1 is a diagram illustrating an overall configuration of an image forming apparatus 1 according to the embodiment. FIG. 2 is a diagram illustrating a schematic configuration of a control unit 10 of the image forming apparatus 1 according to the embodiment.

A basic configuration of the image forming apparatus 1 will first be described.

The image forming apparatus 1 performs image formation by forming a toner image on a sheet as an example of a recording medium and fixing the toner image on the sheet. As illustrated in FIG. 1, the image forming apparatus 1 includes the control unit 10, an image reader 11, an image forming unit 12, a sheet feeding unit 13, a transfer unit 14, a fixing unit 15, a sheet discharging unit 16, a display and control panel 17, and a cooling device 18.

The control unit 10 will now be described in detail.

As illustrated in FIG. 2, the control unit 10 includes a central processing unit (CPU) 1011, a main memory (MEM-P) 1012, a north bridge (NB) 1013, a south bridge (SB) 1014, an accelerated graphics port (AGP) bus 1015, an application specific integrated circuit (ASIC) 1016, a local memory (MEM-C) 1017, a hard disk (HD) 1018, a hard disk drive (HDD) 1019, a peripheral component interconnect (PCI) bus 1020, and a network interface (I/F) 102.

The CPU 1011 processes and calculates data and controls the operations of the image reader 11, the image forming unit 12, the sheet feeding unit 13, the transfer unit 14, the fixing unit 15, the sheet discharging unit 16, and the cooling device 18 in accordance with a program stored in the MEM-P 1012. The MEM-P 1012 serving as a storage area of the control unit 10 includes a read only memory (ROM) 1012*a* and a random access memory (RAM) 1012*b*. The ROM 1012*a* is a memory for storing programs and data for implementing the functions of the control unit 10. The programs stored in the ROM 1012*a* may be provided to the image forming apparatus 1 in the form of an installable or executable file in a computer-readable recording medium, such as a compact disc read only memory (CD-ROM), a floppy disk (FD), a compact disc recordable (CD-R), or a digital versatile disc (DVD).

The RAM 1012*b* is used as a memory for reading programs and data or plotting in memory printing. The NB 1013 is a bridge for connecting the CPU 1011, the MEM-P 1012, the SB 1014, and the AGP bus 1015. The SB 1014 is a bridge for connecting the NB 1013 and a PCI device or a peripheral device. The AGP bus 1015 is a bus interface for a graphics accelerator card to increase the speed of graphics processing.

The ASIC 1016 includes a PCI target, an AGP master, an arbiter (ARB) forming a core part of the ASIC 1016, a memory controller for controlling the MEM-C 1017, and a plurality of direct memory access controllers (DMACs) that perform rotation of image data with hardware logic, for example. The ASIC 1016 is connected to the network I/F 102, such as a universal serial bus (USB) interface or an institute of electrical and electronics engineers (IEEE) 1394 interface, via the PCI bus 1020.

The MEM-C 1017 is a local memory used as a copy image buffer and a code buffer. The HD 1018 is storage for storing image data, font data for use in printing, and forms. The HDD 1019 controls data reading and writing from and to the HD 1018 under the control of the CPU 1011. The network I/F 102 transmits and receives information to and from an external device, such as an information processor, via a communication network.

The image reader 11 will now be described.

As illustrated in FIG. 1, the image reader 11 includes an exposure glass 111 and a read sensor 112. A document recorded with an image is placed on the exposure glass 111, and the read sensor 112 reads the image recorded on the document to generate the image information. Specifically, the image reader 11 directs light onto the document and receives light reflected from the document by using the read sensor 112, such as a charge coupled device (CCD) or a contact image sensor (CIS), to thereby read the image information. The image information corresponds to electrical color separation image signals representing red (R), green (G), and blue (B) that express the image to be formed on the sheet serving as the recording medium.

The image forming unit 12 will now be described.

The image forming unit 12 forms an image (i.e., toner image) by causing toner to adhere to a surface of a later-described intermediate transfer belt 143 of the transfer unit 14 based on the image information read by the image reader 11 or image information received by the network I/F 102.

The image forming unit 12 includes image forming units 120C, 120M, 120Y, and 120K that form toner images with developers containing a toner of cyan (C) color, a toner of magenta (M) color, a toner of yellow (Y) color, and a toner of black (K) color, respectively. The image forming unit 12 further includes an image forming unit 120T that forms a toner image with a clear (T) toner. Hereinafter, each of the image forming units 120C, 120M, 120Y, 120K, and 120T will also be referred to as the image forming unit 120. Further, each of the toners of the cyan, magenta, yellow, and black colors will hereinafter be referred to as a color toner. The color toner is formed of charged resin particles containing a color material such as a pigment or dye.

The clear toner is a colorless transparent toner formed of resin particles configured to make the color toner adhering to the recording medium visible when the color toner is covered by the clear toner, and make the recording medium visible when the recording medium is covered by the clear toner. The clear toner is produced by, for example, adding silicon dioxide ($SiO_2$) or titanium dioxide ($TiO_2$) to the surfaces of particles of a low molecular weight polyester resin. The clear toner may contain a certain amount of a color material, if the clear toner containing the certain amount of the color material still makes the recording medium or the color toner adhering to the recording medium visible.

The image forming unit 120C includes a toner supply unit 121C, a photoconductor drum 122C, a charging unit 123C, an exposure unit 124C, a development unit 125C, a discharging unit 126C, and a cleaning unit 127C.

The toner supply unit 121C stores and supplies the toner of the cyan color to the development unit 125C. A transport screw inside the toner supply unit 121C is driven to supply a predetermined amount of the toner stored in the toner supply unit 121C to the development unit 125C.

A surface of the photoconductor drum 122C is uniformly charged by the charging unit 123C, and an electrostatic latent image is formed on the surface of the photoconductor drum 122C by the exposure unit 124C based on the image information received from the control unit 10. Then, the toner is caused to adhere to the electrostatic latent image formed on the surface of the photoconductor drum 122C by the development unit 125C, to thereby form a toner image. The photoconductor drum 122C is disposed to be in contact with the intermediate transfer belt 143 and rotate in the same direction as the moving direction of the intermediate transfer belt 143 at the point of contact with the intermediate transfer belt 143.

The charging unit 123C uniformly charges the surface of the photoconductor drum 122C. The exposure unit 124C directs light onto the surface of the photoconductor drum 122C charged by the charging unit 123C based on the half-tone area ratio of the cyan color determined by the control unit 10, to thereby form the electrostatic latent image. The development unit 125C causes the toner of the cyan color stored in the toner supply unit 121C to adhere to the electrostatic latent image formed on the surface of the photoconductor drum 122C by the exposure unit 124, to thereby form the toner image.

The discharging unit 126C discharges the surface of the photoconductor drum 122C after the toner image is transferred from the photoconductor drum 122C to the intermediate transfer belt 143. The cleaning unit 127C removes post-transfer residual toner remaining on the surface of the photoconductor drum 122C discharged by the discharging unit 126C.

The image forming units 120M, 120Y, 120K, and 120T similarly include toner supply units 121M, 121Y, 121K, and 121T, photoconductor drums 122M, 122Y, 122K, and 122T, charging units 123M, 123Y, 123K, and 123T, exposure units 124M, 124Y, 124K, and 124T, development units 125M, 125Y, 125K, and 125T, discharging units 126M, 126Y, 126K, and 126T, and cleaning units 127M, 127Y, 127K, and 127T, respectively. The toner supply units 121M, 121Y, 121K, and 121T store the toner of the magenta color, the toner of the yellow color, the toner of the black color, and the clear toner, respectively.

The photoconductor drums 122M, 122Y, 122K, and 122T, the charging units 123M, 123Y, 123K, and 123T, the exposure units 124M, 124Y, 124K, and 124T, the development units 125M, 125Y, 125K, and 125T, the discharging units 126M, 126Y, 126K, and 126T, and the cleaning units 127M, 127Y, 127K, and 127T are similar in function to the photoconductor drum 122C, the charging unit 123C, the exposure unit 124C, the development unit 125C, the discharging unit 126C, and the cleaning unit 127C, respectively, and thus description thereof will be omitted.

Hereinafter, the toner supply units 121C, 121M, 121Y, 121K, and 121T, the photoconductor drums 122C, 122M, 122Y, 122K, and 122T, the charging units 123C, 123M, 123Y, 123K, and 123T, the exposure units 124C, 124M, 124Y, 124K, and 124T, the development units 125C, 125M, 125Y, 125K, and 125T, the discharging units 126C, 126M, 126Y, 126K, and 126T, and the cleaning units 127C, 127M, 127Y, 127K, and 127T will each also be referred to collectively as the toner supply unit 121, the photoconductor drum 122, the charging unit 123, the exposure unit 124, the development unit 125, the discharging unit 126, and the cleaning unit 127, respectively.

The sheet feeding unit 13 will now be described.

The sheet feeding unit 13, which supplies a sheet to the transfer unit 14, includes a sheet container 131, a sheet feed roller 132, a sheet feed belt 133, and registration rollers 134.

The sheet container 131 stores sheets as an example of recording media. The sheet feed roller 132 is disposed to rotate to feed the sheets stored in the sheet container 131 to the sheet feed belt 133. The thus-disposed sheet feed roller 132 picks up the uppermost one of the stored sheets and places the sheet onto the sheet feed belt 133. The sheet feed belt 133 transports the sheet picked up by the sheet feed roller 132 to the transfer unit 14. The registration rollers 134 feed the sheet transported by the sheet feed belt 133 to a transfer area 140 of the transfer unit 14 such that the sheet reaches the transfer area 140 when a portion of the intermediate transfer belt 143 formed with the toner images reaches the transfer area 140.

The transfer unit 14 will now be described.

The transfer unit 14 transfers the images formed on the photoconductor drums 122 by the image forming unit 12 onto the intermediate transfer belt 143 (i.e., primary transfer), and transfers the images transferred to the intermediate transfer belt 143 onto the sheet (i.e., secondary transfer).

The transfer unit 14 includes a drive roller 141, a driven roller 142, the intermediate transfer belt 143, primary transfer rollers 144T, 144C, 144M, 144Y, and 144K, a secondary transfer roller 145, and a secondary facing roller 146. The intermediate transfer belt 143 is wound around the drive roller 141 and the driven roller 142. When the drive roller 141 is driven to rotate, the intermediate transfer belt 143 wound therearound is moved, thereby rotating the driven roller 142. With the rotation of the drive roller 141, the intermediate transfer belt 143 wound around the drive roller 141 and the driven roller 142 moves while in contact with the photoconductor drums 122, thereby transferring the images formed on the photoconductor drums 122 onto the surface of the intermediate transfer belt 143.

The primary transfer rollers 144T, 144C, 144M, 144Y, and 144K are disposed facing the photoconductor drums 122T, 122C, 122M, 122Y, and 122K, respectively, via the intermediate transfer belt 143, and rotate to move the intermediate transfer belt 143. The secondary transfer roller 145 and the secondary facing roller 146 rotate with the intermediate transfer belt 143 and the sheet clamped therebetween.

In the image forming apparatus 1 in FIG. 1, the image forming units 120T, 120C, 120M, 120Y, and 120K are sequentially disposed, in this order, from upstream to downstream in the moving direction of the intermediate transfer belt 143. That is, the clear toner image, the toner image of the cyan color, the toner image of the magenta color, the toner image of the yellow color, and the toner image of the black color are sequentially superimposed and transferred onto the intermediate transfer belt 143 in this order by the primary transfer rollers 144T, 144C, 144M, 144Y, and 144K, respectively. Then, the superimposed toner images on the intermediate transfer belt 143 are transferred onto the sheet all at once, en bloc. Thereby, a transparent layer of the clear toner image is present on the color toner images of the black, yellow, magenta, and cyan colors.

The fixing unit 15 will now be described.

The fixing unit 15 fixes the toners transferred to the sheet by the transfer unit 14. Herein, fixing refers to fusing and fixing a resin component of a toner on a sheet by applying the heat and pressure to the toner at the same time. With the fixing process performed on the toners transferred to the sheet by the transfer unit 14, the toners on the sheet are stabilized.

The fixing unit 15 includes a transport belt 151, a fixing belt 152, a fixing roller 153, a fixing belt transport roller 154, a fixing facing roller 155, and a heat generation unit 156.

The transport belt 151 transports the sheet bearing the toners transferred thereto by the transfer unit 14 to between the fixing roller 153 and the fixing facing roller 155. The fixing belt 152 is wound around the fixing roller 153 and the fixing belt transport roller 154. With the rotation of the fixing roller 153 and the fixing belt transport roller 154, the fixing belt 152 is moved. The fixing roller 153 and the fixing facing roller 155 disposed facing the fixing roller 153 clamp the sheet transported thereto by the transport belt 151 to heat and press the sheet.

As described above, the fixing belt 152 is wound around the fixing roller 153 and the fixing belt transport roller 154. With the rotation of the fixing belt transport roller 154, therefore, the fixing belt 152 is moved. The fixing facing roller 155 is disposed facing the fixing roller 153 to clamp the sheet between the fixing facing roller 155 and the fixing roller 153, as described above. The heat generation unit 156 disposed inside the fixing roller 153 generates the heat to heat the sheet via the fixing roller 153. The sheet is then transported to the sheet discharging unit 16 via a first transport member 20, the cooling device 18, and second transport members 19, which will be described in detail later.

The sheet discharging unit 16 will now be described.

The sheet discharging unit 16 discharges the sheet bearing the toners fixed thereon by the fixing unit 15 from the image forming apparatus 1. The sheet discharging unit 16 includes a sheet discharge belt 161, a sheet discharge roller 162, a sheet discharge port 163, and a sheet receiving tray 164.

The sheet discharge belt 161 transports the sheet subjected to the fixing process of the fixing unit 15 to the sheet discharge port 163. Through the sheet discharge port 163, the sheet discharge roller 162 discharges the sheet transported by the sheet discharge belt 161, and the sheet receiving tray 164 receives the sheet discharged by the sheet discharge roller 162.

The display and control panel 17 will now be described.

The display and control panel 17 includes a panel display unit 171 and a control panel 172. The panel display unit 171 displays set values, menus, and the like, and also serves as a touch panel for receiving inputs from a user, for example. The control panel 172 includes keys that are operated by the user to input information, such as numeric keys for various conditions relating to the image formation and a start key for receiving a copy start instruction.

The clear toner of the present embodiment will now be described in detail.

The clear toner of the present embodiment is an oilless toner applicable to an oilless fixing unit and having characteristics such as a storage elastic modulus G' of 100 or less and a loss tangent tan δ of 10 or greater at the fixing temperature set in the fixing unit 15 of the above-described image forming apparatus 1.

The clear toner, which is also called transparent toner, colorless toner, or pigmentless toner, basically refers to a toner corresponding to a color toner minus a coloring pigment. The clear toner image obtained from the clear toner is rendered transparent because of the lack of a coloring pigment. The clear toner changes the gloss of the image similarly to varnish applied to the image. Therefore, the clear toner is commonly used to form a clear toner image in an area in which a change in gloss is desired. Further, the clear toner applied over a color image prevents color migration due to friction on the surface of the image and protects the image.

It is possible to manufacture the clear toner by various methods including pulverization and polymerization. For example, according to a typical manufacturing method for a polymerized toner, a resin prepolymer having a functional group, a resin such as styrene acrylic resin or polyester resin, a coloring agent, and other additives are dispersed in an organic solvent to prepare a toner material solution, and the toner material solution is cross-linked and/or extended in an aqueous solvent. In the case of the clear toner, a change in the physical properties of a toner matrix resin due to the lack of the coloring pigment may be compensated for by another material. Further, for example, according to a typical manufacturing method for a pulverized toner, a resin, a coloring agent, and other additives are heat-kneaded, cooled, coarsely ground, finely pulverized, and classified.

Although the color of the clear toner in a normal state is white, i.e., the color of a normal resin, the color of the clear toner image subjected to heat fixing is transparent. The clear toner image may become slightly opaque depending on the fixed state, but is transparent in most cases.

The clear toner of the present embodiment is a clear toner having high gloss (hereinafter referred to as high gloss clear toner) allowing the above-described electrophotographic image forming apparatus 1 to obtain a high level of gloss, such as the gloss of a film photo or a varnished image. In the following description, the term "gloss" refers to the 60-degree specular gloss Gs (60°) specified in Specular glossiness—Methods of measurement in Japanese Industrial Standards (JIS) Z 8741-1997).

The gloss Gs (60°) obtained in an electrophotographic image forming apparatus with a commonly used toner ranges from approximately 60 to approximately 70 at most. Meanwhile, a film photo has a gloss Gs (60°) of 90 or greater, and a typical varnished image has a gloss Gs (60°) of 80 or greater. That is, it is difficult to obtain the gloss of a film photo or a varnished image in an electrophotographic image forming apparatus with ordinary toner. Therefore, a clear toner capable of providing a high level of gloss, such as the gloss of a film photo or a varnished image, is herein defined as a high gloss clear toner.

The high gloss clear toner is required to have a storage elastic modulus G' of 100 or less and a loss tangent tan δ of 10 or greater at the set fixing temperature. If the viscoelasticity of the toner thermally fused in the fixing unit 15 is set to the above-described conditions, the spreadability of the toner is improved. As a result, the spread toner is likely to cover a base surface, smoothing the base surface and providing favorable gloss.

To control the viscoelasticity of the thus-thermally fused toner, a toner resin material having improved spreadability may be selected. Such a toner resin material, however, degrades the toner releasability in the fixing process with the heat and pressure. It is therefore necessary to ensure the toner releasability by increasing the amount of a release agent or adding a fine particle material into toner particles.

Materials forming the high gloss clear toner will now be described.

The high gloss clear toner is prepared by mixing a charge control agent, a release agent, and a release agent dispersant in a binder resin mainly composed of a thermoplastic resin, and does not include a pigment. The materials of the high gloss clear toner are not different from those of ordinary toner.

The high gloss clear toner is a magnetic or non-magnetic toner having indeterminate or spherical toner particles manufacturable by various toner manufacturing methods, such as pulverization, polymerization, and granulation.

Examples of resins usable in the high gloss clear toner include epoxy resin, polyester resin, polyamide resin, styrene acrylic resin, styrene methacrylate resin, polyurethane resin, vinyl resin, polyolefin resin, styrene butadiene resin, phenol resin, butyral resin, terpene resin, and polyol resin.

Examples of the vinyl resin include: homopolymers of styrene and substitutes of styrene, such as polystyrene, poly p-chlorostyrene, and polyvinyltoluene; styrene copolymers, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloro-methyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybuthyl methacrylate; polyvinyl chloride; and polyvinyl acetate.

The polyester resin is composed of dihydric alcohol such as those listed in the following group A and dibasic acid salt such as those listed in the following group B, and may further include, as a third component, trihydric or higher polyhydric alcohol or trivalent or higher polyvalent carboxylic acid such as those listed in the following group C:

Group A: ethylene glycol, triethylene glycol, 1,2-propylene glycol, 1,3-propylene glycol, 1,4-butanediol, neopentyl glycol, 1,4-butenediol, 1,4-bis(hydroxy methyl)cyclohexane, bisphenol A, hydrogen-added bisphenol A, polyoxy ethylenated bisphenol A, polyoxy propylene (2,2)-2,2'-bis(4-hydroxy phenyl) propane, polyoxy propylene (3,3)-2,2-bis(4-hydroxy phenyl) propane, polyoxy ethylene (2,0)-2,2-bis(4-hydroxy phenyl) propane, and polyoxy propylene (2,0)-2,2'-bis(4-hydroxy phenyl) propane.

Group B: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linoleic acid, and anhydrides or lower alcohol esters of these acids.

Group C: trihydric or higher polyhydric alcohols such as glycerin, trimethylolpropane, and pentaerythritol and trivalent or higher polyvalent carboxylic acids such as trimellitic acid and pyromellitic acid.

The polyol resin is produced by, for example, reacting an epoxy resin, an alkylene oxide adduct of dihydric phenol or glycidyl ether of the alkylene oxide adduct, a compound intramolecularly including one active hydrogen atom that reacts with an epoxy group, and a compound intramolecularly including two or more active hydrogen atoms that react with an epoxy resin.

Preferably, the high gloss clear toner contains 100 parts or less of bisphenol polyester having a molecular weight ranging from 6300 to 6800. More preferably, the high gloss clear toner contains 90 parts or less of the above-described binder resin.

The charge control agent to be added to the high gloss clear toner may be mixed into the toner particles (i.e., internal addition), or may be added to the surfaces of the toner particles (external addition). The charge control agent provides optimal charge size control according to the development system. Particularly in this disclosure, the charge control agent stabilizes the balance between the particle size distribution and the charge size.

To control the toner to have positive charge, one or a combination of two or more of nigrosine, quaternary ammonium salt, and imidazole metal complexes and salts may be used. Further, to control the toner to have negative charge, salicylic acid metal complexes and salts, organic borates, and calixarene compounds, for example, may be used.

Preferably, the high gloss clear toner contains 2 parts or less of a 3,5-bis(1,1-dimethylethyl)-2-hydroxybenzoate basic zirconium oxide complex salt hydrate (raw material) zirconium compound. More preferably, the high gloss clear toner contains 0.9 parts or less of the above-described charge control agent.

Further, the release agent may be mixed into the toner particles of the high gloss clear toner to prevent toner offset in the fixing process. Examples of the release agent include natural waxes such as candelilla wax, carnauba wax, and rice wax, montan wax, paraffin wax, xazole wax, low molecular weight polyethylene, low molecular weight polypropylene, and alkylphosphoric ester. Preferably, the melting point of the release agent ranges from 65° C. to 90° C. If the melting point of the release agent is lower than this range, toner blocking tends to occur during the storage of the toner. If the melting point of the release agent is higher than this range, toner offset tends to occur in a low-temperature portion of a fixing member.

Preferably, the high gloss clear toner contains 10 parts or less of monoester wax. More preferably, the high gloss clear toner contains 6 parts or less of the above-described release agent.

The high gloss clear toner may further contain an additive to improve the dispersion of the release agent. The additive may be, for example, styrene acrylic resin, polyethylene resin, polystyrene resin, epoxy resin, polyester resin, polyamide resin, styrene methacrylate resin, polyurethane resin, vinyl resin, polyolefin resin, styrene butadiene resin, phenolic resin, butyral resin, terpene resin, polyol resin, or a mixture of two or more of these resins.

Further, the particles of the high gloss clear toner may be surface-treated with fine inorganic powder to improve the fluidity of the toner, for example. The fine inorganic powder may be an oxide or a composite oxide of Si, Ti, Al, Mg, Ca, Sr, Ba, In, Ga, Ni, Mn, W, Fe, Co, Zn, Cr, Mo, Cu, Ag, V, or Zr, for example. Particularly, fine particles of silicon dioxide (silica), titanium dioxide (titania), or alumina are preferably used as the fine inorganic powder. Further, it is effective to perform surface-reforming on the particles of the high gloss clear toner with a hydrophobizing agent or the like.

Typical examples of the hydrophobizing agent include dimethyldichlorosilane, trimethylchlorosilane, methyltrichlorosilane, allyldimethyldichlorosilane, allylphenyldichlorosilane, benzyldimethylchlorosilane, brommethyldimethylchlorosilane, α-chloroethyltrichlorosilane, p-chloroethyltrichlorosilane, chloromethyldimethylchlorosilane, chloromethyltrichlorosilane, hexaphenyldisilasan, and hexatolyldisilasan.

It is preferable to add 0.1 wt % to 2 wt % of the fine inorganic powder to the high gloss clear toner. If the fine inorganic powder added to the high gloss clear toner is less than 0.1 wt %, the effect of preventing toner aggregation is insufficient. If the fine inorganic powder added to the high gloss clear toner is more than 2 wt %, toner scattering between fine lines, contamination of the interior of the image forming apparatus 1, scratches and abrasion on the photoconductor drums 122 tend to occur.

Preferably, the high gloss clear toner contains 10 parts or less of styrene resin, acrylonitrile resin, and butyl acrylate resin. More preferably, the high gloss clear toner contains 5 parts or less of the above-described additive for improving the dispersion of the release agent.

A manufacturing method of the high gloss clear toner will now be described.

The manufacturing method of the high gloss clear toner of the present embodiment may be pulverization, polymerization (e.g., suspension polymerization, emulsion polymerization, dispersion polymerization, emulsion aggregation, or emulsion association), or the like. However, the manufacturing method of the high gloss clear toner of the present embodiment is not limited thereto, and is not different from a manufacturing method of ordinary toner.

As an example of the method of manufacturing a toner by pulverization, the above-described resin, a pigment or dye serving as a coloring agent, a charge control agent, a release agent, and other additives are first sufficiently mixed in a mixing machine such as a Henschel mixer. Thereafter, the materials of the toner are sufficiently kneaded with a batch double roll, a Banbury mixer, a continuous biaxial extruder, or a continuous uniaxial kneader. The continuous biaxial extruder may be, for example, a KTK-type biaxial extruder manufactured by Kobe Steel, Ltd., a TEM-type biaxial extruder manufactured by Toshiba Machine Co., Ltd., a biaxial extruder manufactured by KCK Co., a PCM-type biaxial extruder manufactured by Ikegai, Ltd., or a KEX-type biaxial extruder manufactured by Kurimoto, Ltd. The continuous uniaxial kneader may be, for example, a heat kneader such as Co-Kneader manufactured by Buss Corporation.

The mixture is then cooled, coarsely ground with a hammer mill or the like, finely pulverized with a fine pulverizer using a jet stream or a mechanical pulverizer, and classified to a predetermined particle size with a classifier using swirling stream or a classifier using the Coanda effect. Thereafter, an additive including inorganic particles is mixed into the mixture with a mixer such that the additive adheres or sticks to the surfaces of particles of the mixture, and the mixture is sieved through a sieve having a mesh size of at least 250 μm to remove coarse particles and aggregated particles, to thereby obtain the toner.

The high gloss clear toner of the present embodiment has a weight-average particle diameter ranging preferably from 4 μm to 10 μm, more preferably from 5 μm to 8 μm. If the weight-average particle diameter of the high gloss clear toner is less than 4 μm, the contamination of the interior of the image forming apparatus 1 due to toner scattering occurring during the use of the image forming apparatus 1 over an extended time, the reduction in image density in a low-humidity environment, and the deterioration of the photoconductor drum cleaning performance are likely to occur. If the weight-average particle diameter of the high gloss clear toner is greater than 10 μm, the resolution in a microspot having a size of 100 μm or smaller is insufficient, and toner scattering is increased in a clear area in which the image is not supposed to be formed, thereby degrading the image quality.

As an example of the method of manufacturing a toner by polymerization, a coloring agent, a charge control agent, and the like are added to a monomer to prepare a monomer composition, and the monomer composition is suspended and polymerized in an aqueous medium to obtain toner particles. The method of granulating the toner particles is not particularly limited.

For example, a toner of the present embodiment is obtained as follows. That is, oil-based dispersion liquid is prepared which is an organic solvent containing at least a polyester-based prepolymer including an isocyanate group and dissolved therein, a pigment-based coloring agent dispersed therein, and a release agent dissolved or dispersed therein. Then, the oil-based dispersion liquid is dispersed in an aqueous medium with fine inorganic particles and/or fine polymer particles. In the dispersion liquid, the prepolymer is reacted with polyamine and/or monoamine including an active hydrogen-containing group, to thereby form a urea-modified polyester resin including a urea group. Then, the fluid medium is removed from the dispersion liquid containing the urea-modified polyester resin, to thereby obtain the toner.

A description will now be given of a method of measuring the storage elastic modulus G' and the loss tangent tan δ of the high gloss clear toner.

Viscoelasticity is one of several indicators for evaluating dynamic characteristics of a high polymer material having both elasticity and viscosity. To measure the viscoelasticity of a material, stress from the material is detected while the material is subjected to sinusoidal strain, and the storage elastic modulus G', the loss elastic modulus G", and the loss tangent tan δ serving as indicators of dynamic viscoelasticity are measured from the waveform of the strain and the waveform of stress. The storage elastic modulus G' of the material is defined as the ratio of elastic stress having the same phase as the phase of the strain, and represents the ability of the material to elastically store the energy, which is an elastic characteristic. The loss elastic modulus G" of the material refers to the ratio of a phase different from the phase of the strain, and represents the ability of the material to release the stress as the heat, which is a viscous characteristic. The ratio G"/G' of the two elastic moduli is defined as the loss tangent tan δ, which represents the ratio of a viscous component of the material to an elastic component of the material. The values of the above-described parameters are obtained by shear measurement and thus are represented in the shear elastic modulus G. The values of the parameters, however, may be represented in the elongation elastic modulus E, if the values are obtained by elongation or bending measurement.

The parameters are normally measured by a dynamic mechanical analysis (DMA) device. DMA is a method of measuring dynamic characteristics of a sample by applying strain or stress that changes (i.e., vibrates) with time to the sample and measuring stress or strain generated by the applied strain or stress. The sample is placed on a measurement probe, heated by a heater or the like, and subjected to stress applied by a load generation unit via the probe. The stress is applied as sinusoidal force according to the frequency set as one of several measurement conditions such that the sample has a constant strain amplitude. The amount of deformation (i.e., strain) caused in the sample by the sinusoidal force is detected by a displacement detector, and various viscoelasticity values, such as the elastic modulus and the coefficient of elasticity, are calculated from the stress to the sample and the detected strain and output as functions of the temperature or time. The storage elastic modulus G', the loss elastic modulus G", and the loss tangent tan δ are calculated from the above measurement results.

In the present embodiment, with a rheometer Rheo Stress RS 150 manufactured by Haake Corporation, periodical strain was applied to a disc-shaped sample pressure-molded from approximately 0.2 g of toner with pressure of 10 tons and clamped by a disc-shaped measuring jig in a temperature range of from 120° C. to 200° C. Then, stress generated by the strain was carefully measured and the storage elastic modulus G' and the loss tangent tan δ were calculated.

As described above, the high gloss clear toner of the present embodiment has a storage elastic modulus G' of 100 or less and a loss tangent tan δ of 10 or greater at the set fixing temperature. A toner having such characteristics is well spread when subjected to the heat and pressure supplied by the fixing unit 15, and provides high gloss to the image. On the other hand, such a toner may exhibit poor releasability in the heating and pressing processes.

A typical countermeasure is the application of silicone oil or the like to the fixing device to minimize the deterioration of toner releasability. By contrast, the high gloss clear toner of the present embodiment maintains the releasability from the fixing unit 15 with the increase in amount of the release agent and the addition of the fine particle material into the particles of the high gloss clear toner. Thus, there is no need to apply silicone oil or the like to the fixing unit 15. That is, the high gloss clear toner of the present embodiment is usable in a so-called oilless fixing device that obviates the need to apply a release agent such as silicone oil to fixing members.

Figure 3:
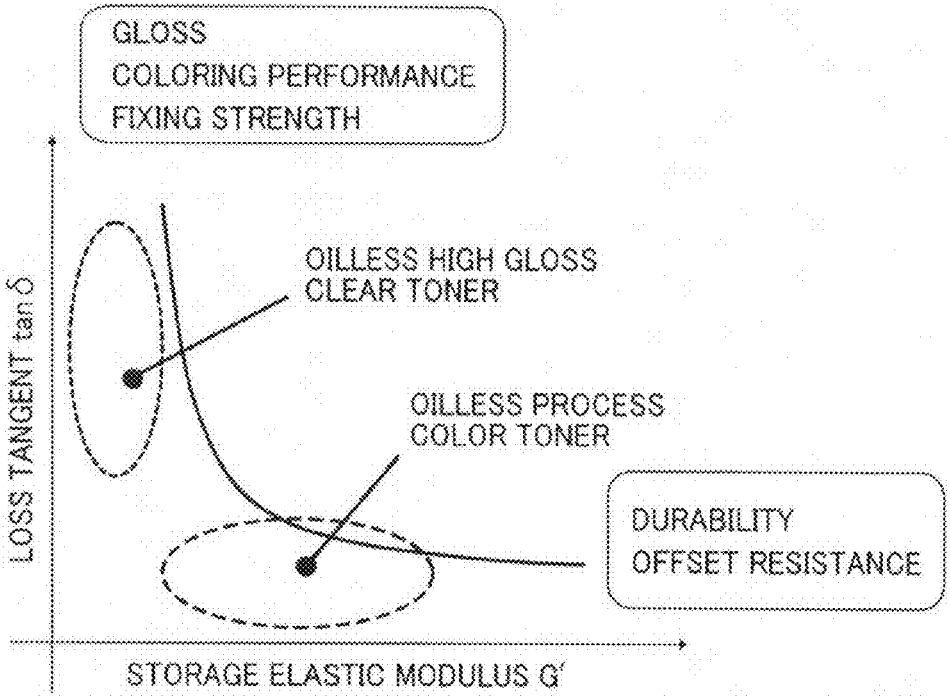
FIG. 3 is a graph illustrating differences in value of physical properties between a high gloss clear toner and process color toners of the embodiment.

FIG. 3 illustrates differences in value of the above-described physical properties between the high gloss clear toner and the process color toners of the cyan, magenta, yellow, and black colors of the present embodiment. The process color toners used in the present embodiment are also oilless toners similar to the high gloss clear toner of the present embodiment.

As illustrated in FIG. 3, the relationship between the storage elastic modulus G' and the loss tangent tan δ significantly affects basic toner characteristics such as gloss, coloring performance, fixing strength, durability, and offset resistance. Among these characteristics, the offset resistance tends to deteriorate with the reduction of the storage elastic modulus G' and the increase of the loss tangent tan δ. As illustrated in FIG. 3, the process color toners tend to have a large storage elastic modulus G' and a small loss tangent tan δ to attain both "coloring performance and fixing strength" and "durability and offset resistance." Contrastively, the high gloss clear toner has a small storage elastic modulus G' and a large loss tangent tan δ to increase the gloss. Therefore, the offset resistance of the high gloss clear toner is lower than the offset resistance of the process color toners.

The offset resistance will now be described in detail.

Figure 4:
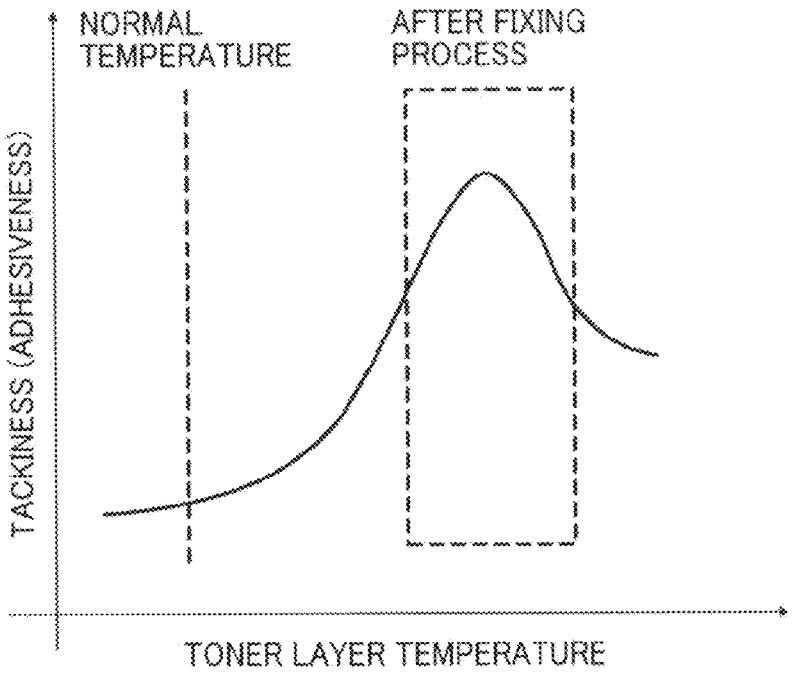
FIG. 4 is a graph illustrating the relationship between toner layer temperature and toner tackiness (i.e., adhesiveness)

FIG. 4 is a graph illustrating the relationship between toner layer temperature and toner adhesiveness (i.e., tackiness). In the fixing unit 15, a toner layer on the sheet has a high temperature. In a high-temperature portion of the toner layer immediately after the fixing process of the fixing unit 15, the toner adhesiveness (i.e., tackiness) is higher than at normal temperature. If the high-temperature toner layer comes into contact with the second transport members 19 downstream of the fixing unit 15 in the sheet transport direction, the toner is likely to be offset (i.e., transferred) to the second transport members 19. The toner offset to the second transport members 19 gradually sticks to and aggregates on the second transport members 19, forming a scratch in an image later passing through the second transport members 19.

A description will now be given of a method of evaluating the offset resistance.

Herein, a tape peel test is conducted as the method of evaluating the offset resistance. In the tape peel test, a tape is previously placed on an image formed on a sheet. The tape is then peeled off the image while the sheet is warm. Since the toner adheres to the tape, it is possible to evaluate the offset resistance based on the amount of toner adhering to the tape. Specifically, if a large amount of toner adheres to the tape, it is determined that the toner has low offset resistance. The tape peel test allows the evaluation of the resistance of the toner against force acting in an offset direction (i.e., a direction perpendicular to the sheet surface) and the evaluation of the offset resistance of the toner at a high temperature.

The tape peel test is conducted as follow: 1) place a heat-resistant tape on an image formed on a sheet, 2) heat the sheet to a given temperature, 3) after the lapse of a predetermined time, carefully peel the tape off the image while the sheet is warm, 4) place the tape on a white sheet and measure the image density or the weight of the tape, and 5) use the image density or the weight of the tape as an indicator of the offset resistance. Herein, the heat-resistant tape is used, since the adhesiveness of the heat-resistant tape is unlikely to be changed by the change in temperature. Further, in the case of a clear toner, the weight of the tape may be measured because of difficulty to measure the image density of the clear toner.

Figure 5:
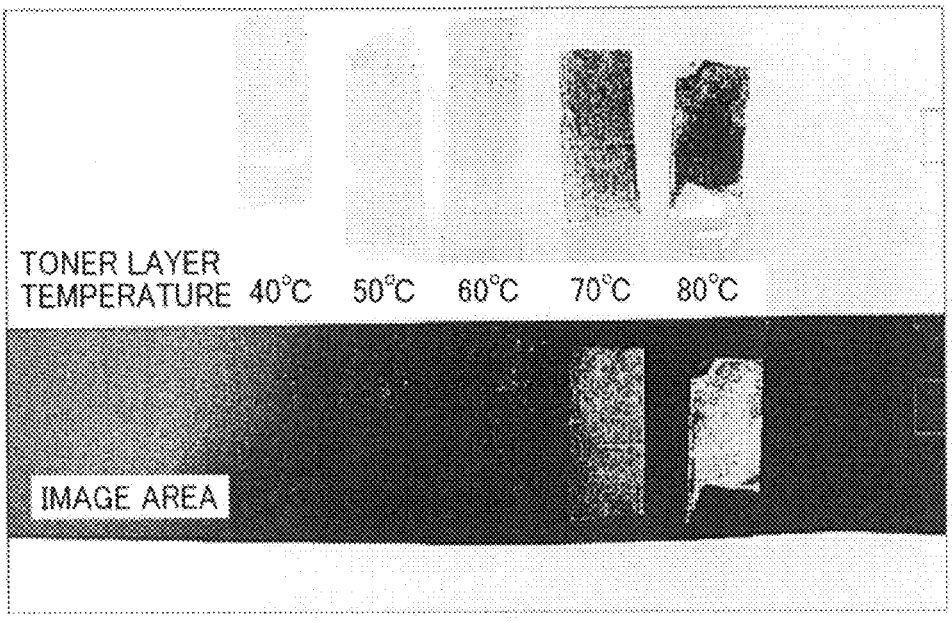
FIG. 5 is a diagram illustrating an example of offset resistance evaluation based on a tape peel test at different toner layer temperatures.

FIG. 5 illustrates an example of the offset resistance evaluation based on the tape peel test at different toner layer temperatures. For clarity, FIG. 5 illustrates the evaluation of the offset resistance based on the measurement of the image density of a color toner.

As illustrated in FIG. 5, in the evaluation of the offset resistance at different toner layer temperatures, there is a critical temperature threshold across which the offset resistance substantially changes. In the example illustrated in FIG. 5, the critical temperature corresponds to a range from 60° C. to 70° C., and the image density on the tape as an indicator of the offset resistance substantially changes across this temperature range. That is, it is understood that the offset resistance is substantially low when the toner layer temperature is higher than the critical temperature, and that the offset resistance is high when the toner layer temperature is equal to or lower than the critical temperature. If the cooling device 18 reduces the toner layer temperature to or below the critical temperature after the fixing process, therefore, the toner is prevented from being offset to the second transport members 19 when the toner comes into contact with the second transport members 19 while the toner layer is at a high temperature immediately after the fixing process.

Figure 6:
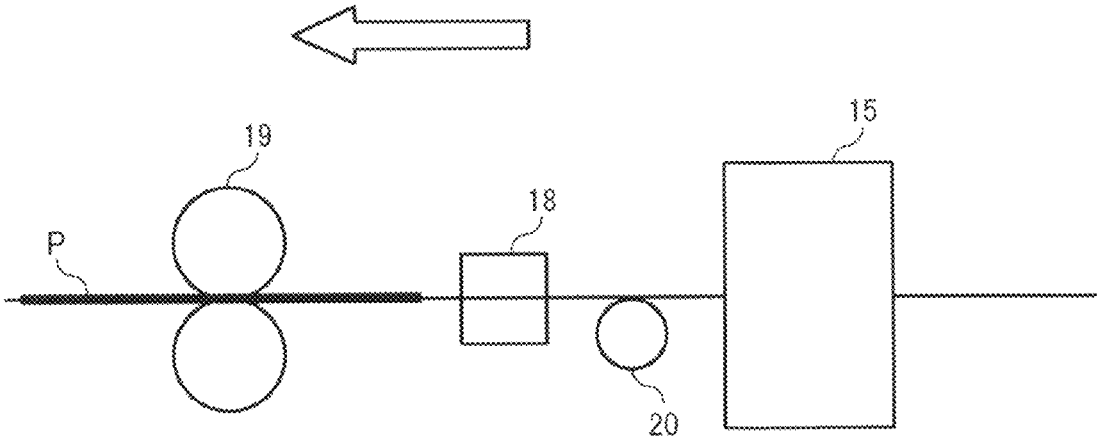
FIG. 6 is a diagram illustrating a schematic configuration of members located downstream of a fixing unit in a sheet transport direction.

FIG. 6 is a diagram illustrating a schematic configuration of members located downstream of the fixing unit 15 in the sheet transport direction indicated by the arrow in the drawing. The image forming apparatus 1 includes the cooling device 18 disposed downstream of the fixing unit 15 to cool a sheet P subjected to the fixing process. The offset resistance of the high gloss clear toner of the present embodiment is lower than the offset resistance of the process color toners. To prevent the offset of the high gloss clear toner to the second transport members 19 downstream of the fixing unit 15, therefore, it is necessary to sufficiently cool the high gloss clear toner by using the cooling device 18.

That is, higher cooling power is required when the high gloss clear toner is used than when the process color toners are used. It is therefore necessary to increase the cooling power of the cooling device 18. However, constantly maintaining high cooling power in an image forming system is undesirable in terms of energy conservation. In the image forming apparatus 1 according to the present embodiment, therefore, the cooling power of the cooling device 18 is changed based on whether or not the toner image is formed with the high gloss clear toner. In the following, the cooling device 18 will be described in detail based on embodiment examples.

Figure 7:
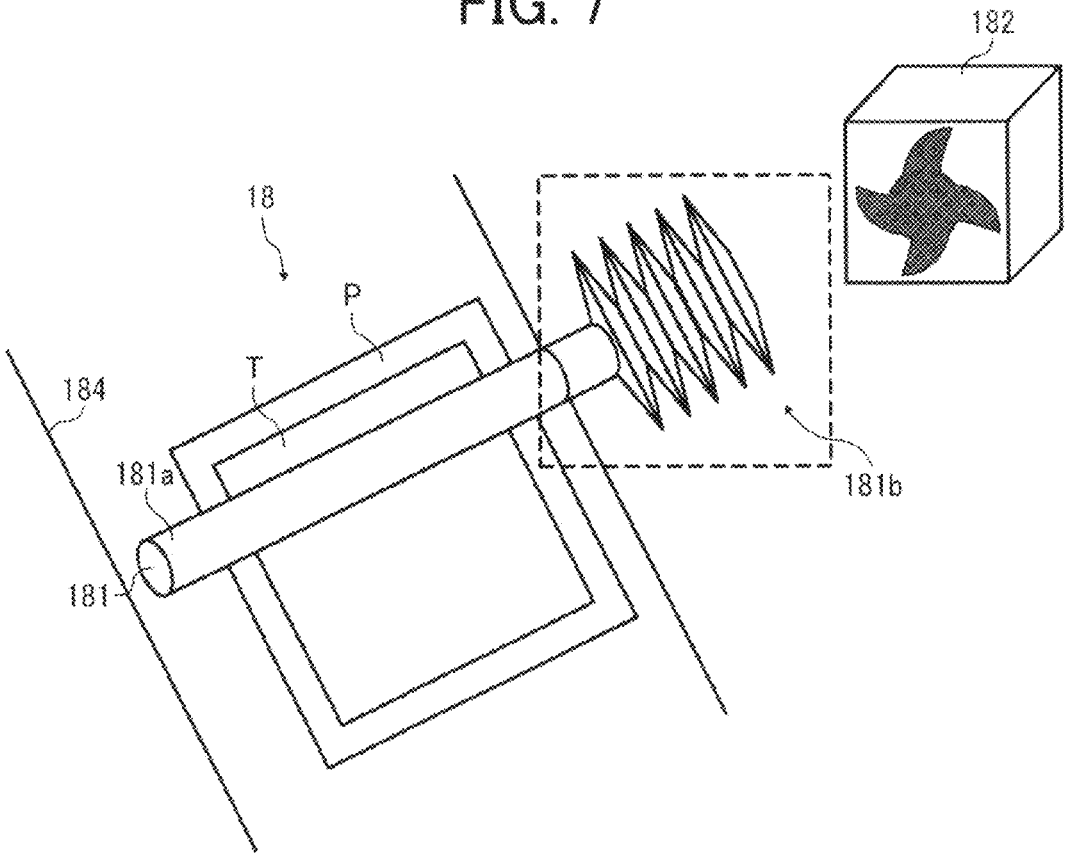
FIG. 7 is a perspective view of a cooling device according to a first example.

The cooling device 18 according to a first example will be described. FIG. 7 is a perspective view of the cooling device 18 according to the first example. The cooling device 18 employs a heat pipe 181 serving as a contact-type cooling device. The contact-type cooling device directly contacts a toner image T on the sheet P to cool the toner image T, and thus is capable of providing high cooling power. The heat pipe 181 includes a high-temperature portion 181*a* that comes into contact with the toner image T on the sheet P to absorb the heat and a low-temperature portion 181*b* that releases the heat. Preferably, a coolant such as water is circulated in the heat pipe 181. The cooling device 18 further includes an auxiliary cooling device for auxiliary cooling of the heat pipe 181 serving as the contact-type cooling device. Preferably, the auxiliary cooling device performs air cooling. More preferably, the auxiliary cooling device is a forced cooling device, such as a fan 182. The cooling device 18 further includes a transport belt 184 for transporting the sheet P to bring the toner image T on the sheet P into contact with the high-temperature portion 181*a* of the heat pipe 181.

The heat pipe 181 has an external wall made of a high thermal conductive material such as iron (Fe) and a hollow interior in which an operating fluid such as water is sealed.

The principle of the heat pipe 181 is as follows: 1) upon contact of the high-temperature portion 181*a* of the heat pipe 181 with the toner image T, the heat is transferred to the high-temperature portion 181*a* of the heat pipe 181 from the toner image T, 2) the operating fluid inside the heat pipe 181 absorbs the heat and evaporates, and 3) the vapor is cooled in the low-temperature portion 181*b* of the heat pipe 181 to return to liquid. The above-described three steps are repeated.

The surface area of the low-temperature portion 181*b* of the heat pipe 181 is increased to increase the cooling power. With the fan 182 blowing air against the low-temperature portion 181*b* of the heat pipe 181 having the increased surface area, the operating fluid inside the heat pipe 181 is effectively cooled.

The cooling power of the heat pipe 181 operating on the above-described principle largely depends on the cooling power of the fan 182. That is, the cooling power of the heat pipe 181 is increased with the increase of the volume of air blown by the fan 182. Therefore, the cooling power of the heat pipe 181 is controlled by controlling the rotation rate of the fan 182 to adjust the volume of air to be blown. To obtain high cooling power of the heat pipe 181, it is necessary to increase the rotation rate of the fan 182 for cooling the heat pipe 181 to increase the volume of air directed onto the heat pipe 181 per unit time, which means an increase in required power. As described above, constantly maintaining high cooling power, i.e., the increase in required power, in an image forming system is undesirable in terms of energy conservation and should be avoided.

In the present example, therefore, the rotation rate of the fan 182 is controlled based on whether or not the toner image is formed with the high gloss clear toner. That is, when the process color toners are used, the fan 182 is driven at a low rotation rate to set the cooling power of the heat pipe 181 to a predetermined level. Meanwhile, when the high gloss clear toner is used, the fan 182 is driven at a high rotation rate to increase the cooling power of the heat pipe 181 to be higher than the predetermined level, thereby reducing the temperature of the toner image T to a temperature range in which the offset of the high gloss clear toner is prevented.

The cooling device 18 may include multiple fans 182, to change the cooling power of the cooling device 18 by activating only one of the fans 182 when the process color toners are used and activating the multiple fans 182 when the high gloss clear toner is used.

Further, the cooling device 18 may include multiple heat pipes 181 to control the cooling power of the cooling device 18. For example, the cooling device 18 may include two heat pipes 181 disposed in parallel along the sheet transport direction and one or two fans 182 disposed for each of the heat pipes 181 so as to activate only the fan(s) 182 corresponding to one of the heat pipes 181 when the process color toners are used, and activate the fans 182 corresponding to the two heat pipes 181 when the high gloss clear toner is used.

The heat pipe 181 rotates at the same speed as the transport speed of the sheet P. Therefore, the heat pipe 181 is capable of cooling the sheet P while stably transporting the sheet P without causing a sheet jam.

To drive the image forming apparatus 1 with minimum necessary power, the cooling power is controlled based on whether the process color toner or the high gloss clear toner is used, i.e., the cooling power is increased only when the high gloss clear toner is used to prevent the offset of the high gloss clear toner.

Whether or not the high gloss clear toner is to be used is determined based on user information of a user setting item previously provided with mode options such as "high gloss clear toner mode" and "no high gloss clear toner mode," for example. This is a simple configuration not requiring a special sensor. Further, the configuration not requiring a sensor is advantageous in that there is no increase in cost. It is of course possible to employ another method of controlling the cooling power of the cooling device 18, but the following description is based on an assumption that the cooling power of the cooling device 18 is controlled with the use of the user setting item.

Figure 8:
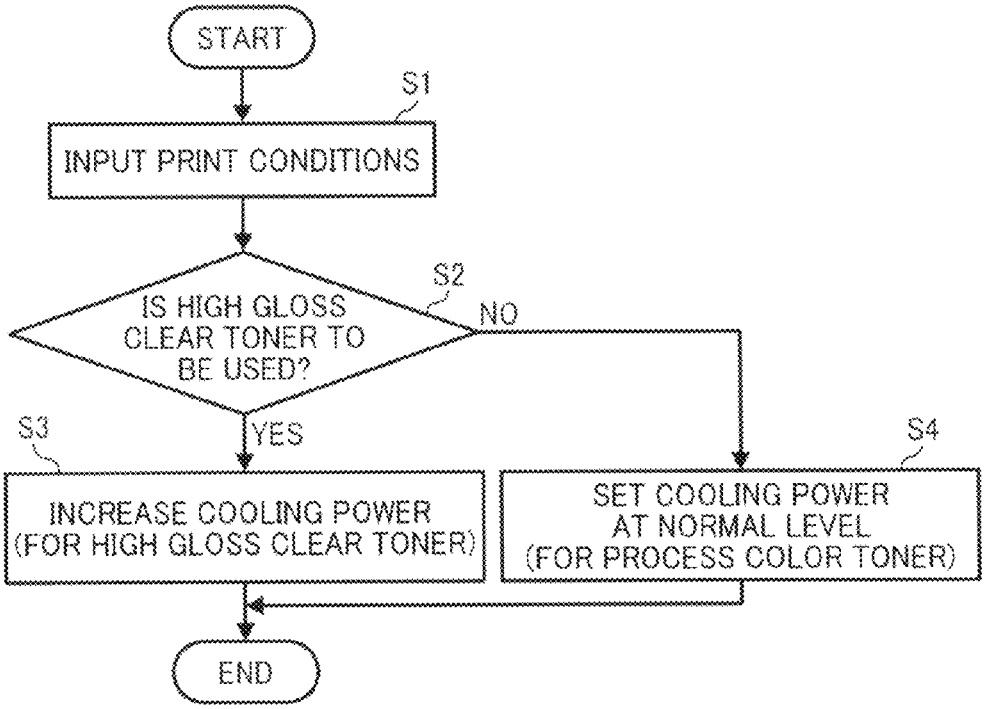
FIG. 8 is a flowchart of a cooling power control for controlling the cooling power of the cooling device according to the first example.

FIG. 8 is a flowchart illustrating a control of the cooling power of the cooling device 18 according to the first example. A user first inputs print conditions (step S1). In this step, the user specifies whether or not to use the high gloss clear toner in the printing. Then, the control unit 10 determines whether or not the high gloss clear toner is to be used based on the user information (step S2). If the use of the high gloss clear toner has been specified (YES at step S2), the control unit 10 increases the cooling power of the cooling device 18 to be higher than the cooling power for the process color toners (step S3). In this case, the cooling power needs to be high enough to reduce the temperature of the toner image to at least the offset resistance critical temperature or lower after the cooling process. Meanwhile, if the user has specified non-use of the high gloss clear toner (NO at step S2), the control unit 10 maintains the cooling power of the cooling device 18 at a normal level for the process color toners (step S4).

A cooling device 18' according to a second example will now be described.

Figure 9A:
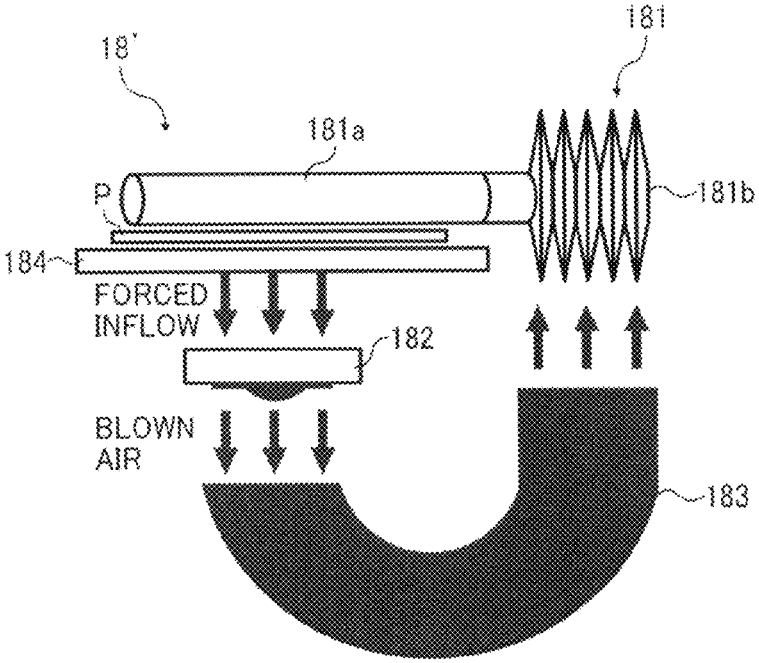
FIGS. 9A and 9B are a schematic diagram of a cooling device according to a second example and a top view of a transport belt in the cooling device, respectively.

FIG. 9A is a schematic diagram of the cooling device 18' according to the second example. The cooling device 18' employs the heat pipe 181 similarly to the cooling device 18 according to the first example, and is similar to the cooling device 18 according to the first example in the cooling principle and the cooling power control. In the second example, the fan 182 for cooling the heat pipe 181 is disposed at a position different from the position of the fan 182 in the first example so as to cool the toner image more effectively. Specifically, the fan 182 is disposed immediately under the transport belt 184 to cool the sheet P also from below.

Figure 9B:
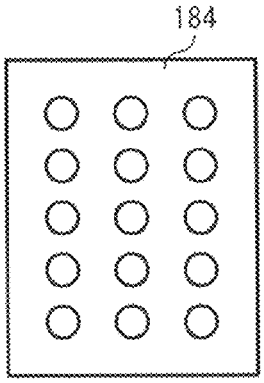

As illustrated in FIG. 9A, with the fan 182 disposed immediately under a sheet path, an airflow generated by the fan 182 is directed to the heat pipe 181 through a duct 183. In this process, a forced inflow of air is generated above the fan 182 owing to the airflow toward the heat pipe 181. As illustrated in FIG. 9B, the transport belt 184 forming the sheet path has multiple holes, through which the sheet P is attracted to the transport belt 184, and the heat is taken from the sheet P. As a result, the sheet P is cooled from below. Further, this configuration keeps the sheet P in close contact with the transport belt 184, thereby improving sheet transport performance and reducing the incidence of sheet jam.

A cooling device 18" according to a third example will now be described. The cooling device 18" according to the third example employs the heat pipe 181 similarly to the cooling device 18 according to the first example. In the third example, the time of contact between the sheet P and the heat pipe 181 is controlled to control the cooling power.

A heat amount Q taken from the sheet P by the heat pipe 181 is determined by the following expression:

$$Q \propto (T1-T2)\Delta t \quad (1)$$

Herein, T1 represents the temperature of the sheet P, T2 represents the temperature of the heat pipe 181, and Δt represents the cooling time.

Methods for obtaining high cooling power include a method of reducing the temperature T2 of the heat pipe 181 (i.e., the method employed in the first and second examples) and a method of extending the cooling time Δt. For example, according to the method of extending the cooling time Δt, the cooling time Δt is doubled to double the cooling power. Specifically, the transport speed of the sheet P is halved. Meanwhile, according to the method of reducing the temperature T2 of the heat pipe 181, if the current temperature T1 of the sheet P is 80° C. and the current temperature T2 of the heat pipe 181 is 50° C., for example, it is necessary to reduce the temperature T2 of the heat pipe 181 to 20° C. To reduce the current temperature T2 of the heat pipe 181 by 30° C., it is necessary to increase the size of the cooling device 18 or 18'. Further, to make the temperature T2 of the heat pipe 181 lower than normal room temperature of approximately 25° C., cooling the heat pipe 181 only with the fan 182 is insufficient, and thus the cooling device 18 or 18' needs to include a freezing system or the like, which is impractical.

In the present example, therefore, the cooling time Δt is extended to increase the cooling power with a simple configuration. The extension of the cooling time Δ, however, leads to a reduction in productivity. Thus, there is a limitation in the increase of the cooling time Δt. If simply extending the cooling time Δt does not sufficiently increase the cooling power, the volume of air to be blown by the fan 182 is increased, as in the first and second examples, to reduce the temperature T2 of the heat pipe 181 to compensate for a shortfall of the cooling power.

To increase the cooling power by obtaining a sufficient cooling time with the extension of the time of contact between the sheet P and the heat pipe 181, the respective rotation speeds of the heat pipe 181 and the transport belt 184 in the cooling device 18" are reduced. The reduction of the transport speed of the sheet P to obtain a sufficient cooling time, however, may reduce productivity of the image forming apparatus 1. It is therefore necessary to maintain overall productivity of the image forming apparatus 1 while reducing the transport speed of the sheet P transported by the cooling device 18".

Normally, the space between adjacent sheets P is maintained at a predetermined length because, to maintain a constant image density, the image forming apparatus 1 forms a test image pattern between the adjacent sheets P, detects the test image pattern, and performs process control based on the detection of the test image pattern. Specifically, the image forming apparatus 1 forms a solid or halftone test image pattern between the adjacent sheets P on the intermediate transfer belt 143, detects the test image pattern, and performs feedback control of the image density based on the detection of the test image pattern, to thereby determine image forming conditions. In other words, the length of the space between the adjacent sheets P maintained for the process control is no longer necessary at a position near the cooling device 18" downstream of the intermediate transfer belt 143 in the sheet transport direction. Therefore, the length of the space between the adjacent sheets P is adjusted to control the transport of the sheet P so as to maintain productivity of the image forming apparatus 1 while reducing the linear speed of the transported sheet P.

FIGS. 10A to 10D are schematic diagrams illustrating a sheet transport control for maintaining productivity while increasing the cooling power. On the downstream side of the fixing unit 15 in the sheet transport direction, the first transport member 20, the cooling device 18", and the second transport members 19 are disposed in this order. The first transport member 20, the cooling device 18", and the second transport members 19 transport the sheet P as follows. The first transport member 20 transports the sheet P while rotating in contact with the lower surface of the sheet P. The cooling device 18" transports the sheet P with the heat pipe 181 and the transport belt 184 rotating while clamping the sheet P therebetween. The second transport members 19 rotate while clamping the sheet P therein, to thereby transport the sheet P.

Figure 10A:
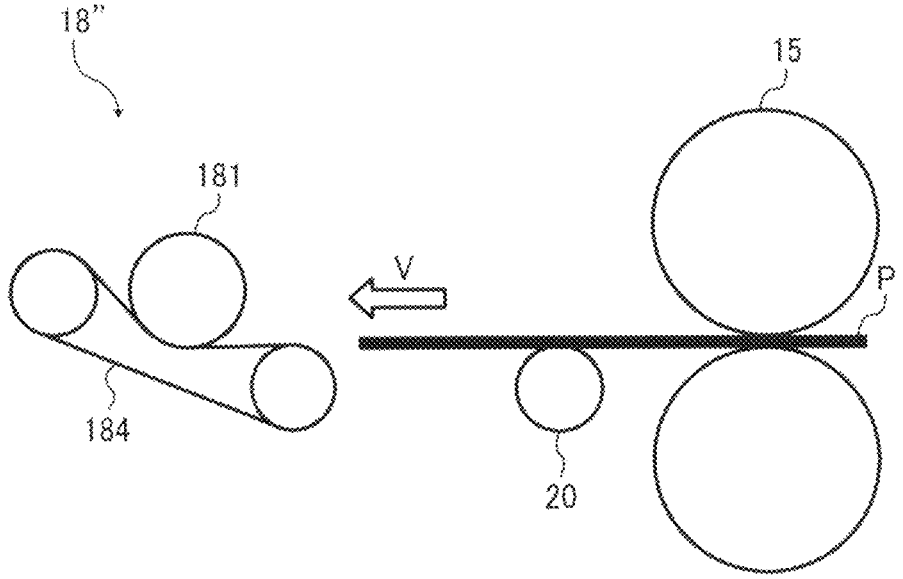
FIGS. 10A to 10D are schematic diagrams illustrating a sheet transport control according to a third example for maintaining productivity while increasing the cooling power.
Figure 10B:
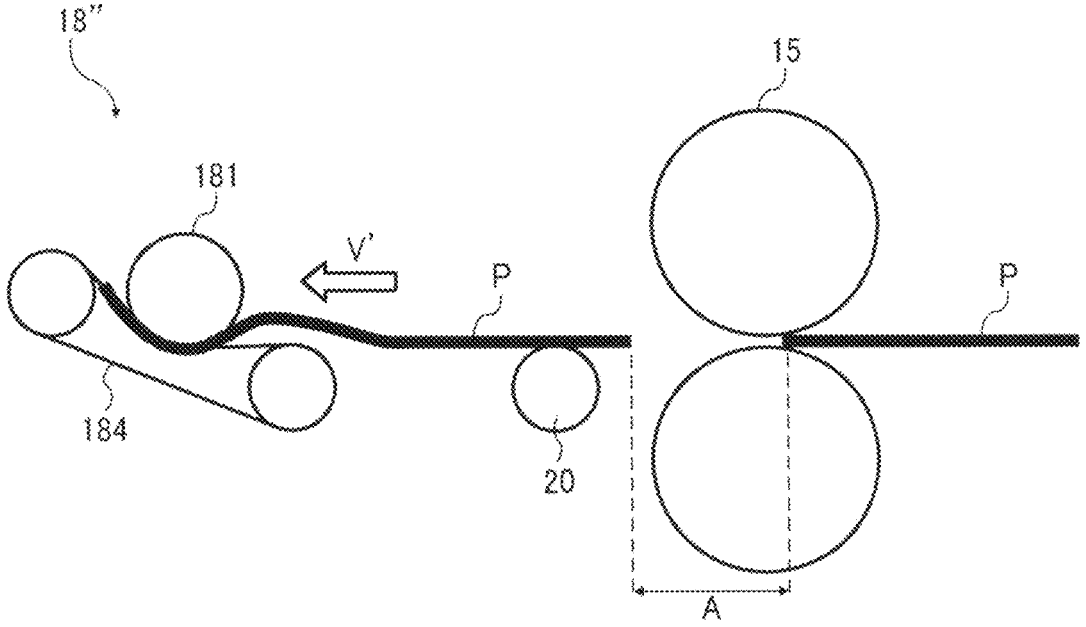
Figure 10C:
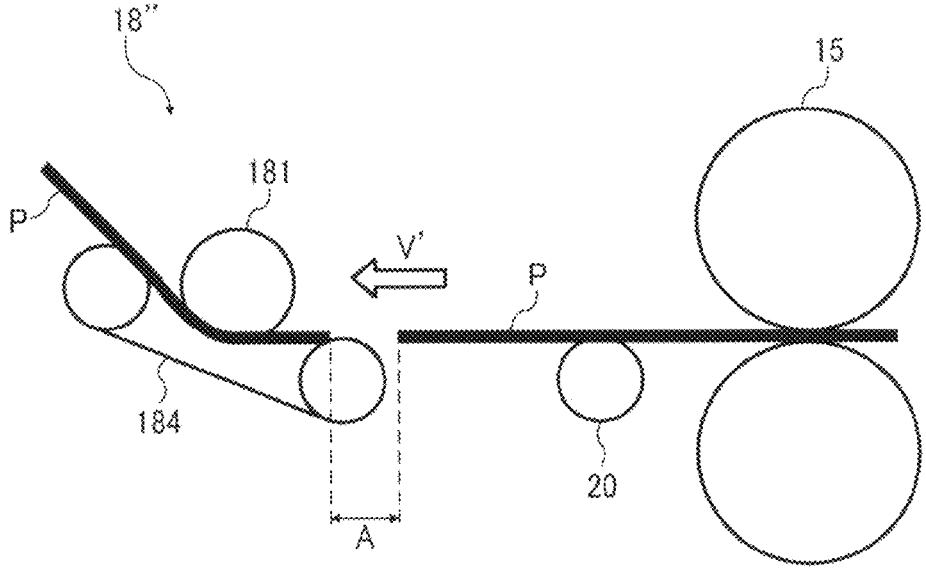

As illustrated in FIG. 10A, to maintain productivity, the sheet P is transported at a normal speed V until the sheet P passes through the fixing unit 15. Then, as illustrated in FIG. 10B, upon arrival of the sheet P to the heat pipe 181, the transport speed of the sheet P is reduced from the normal speed V to a reduced speed V' to transport the sheet P at the reduced speed V'. With the reduction of the transport speed of the sheet P, a length A of the space between the sheet P and the next sheet P transported at the normal speed V is gradually reduced, as illustrated in FIG. 10C. It is therefore necessary to specify the value by which the normal speed V is to be reduced to prevent the next sheet P from catching up with the preceding sheet P. That is, it is necessary to control the reduced speed V' to satisfy a range represented by the following expression:

$$V > V' > B/(A+B) \times V \quad (2)$$

Herein, A represents the length of the space maintained between the adjacent sheets P for the process control, B represents the length of each of the long sides of the sheets P, V represents the normal speed for transporting the sheets P, and V' represents the reduced speed for transporting the sheets P.

Figure 10D:
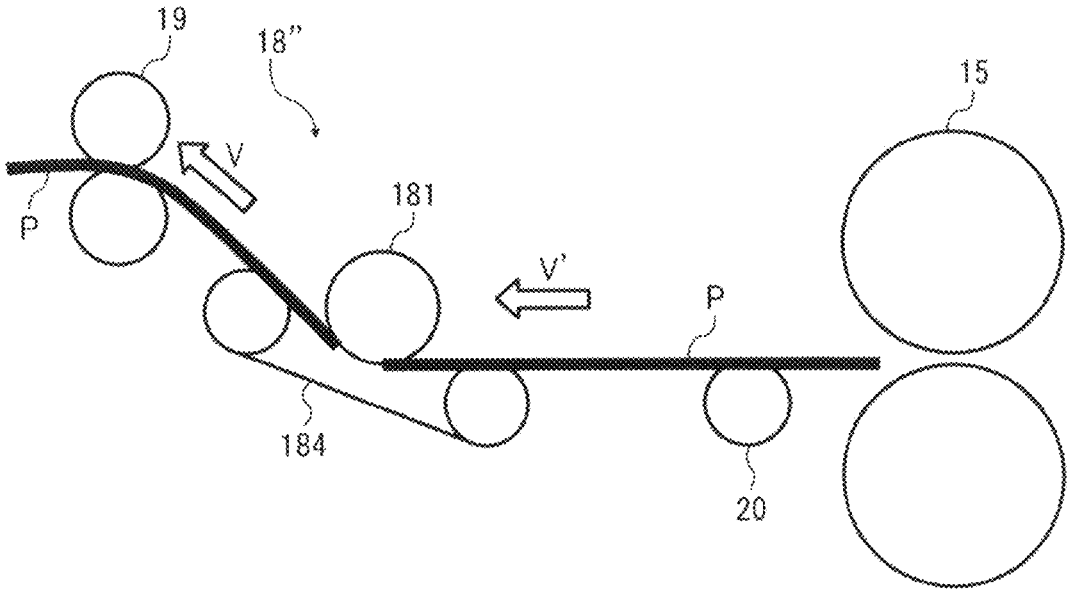

As illustrated in FIG. 10D, after the sheet P passes through the heat pipe 181, the linear velocity of the sheet P is returned to the normal speed V from the reduced speed V'. The length of the space between the adjacent sheets P maintained for the process control is thus adjusted to control the linear velocity of the sheet P at the respective positions as described above, to thereby maintain productivity of the image forming apparatus 1.

Figure 11:
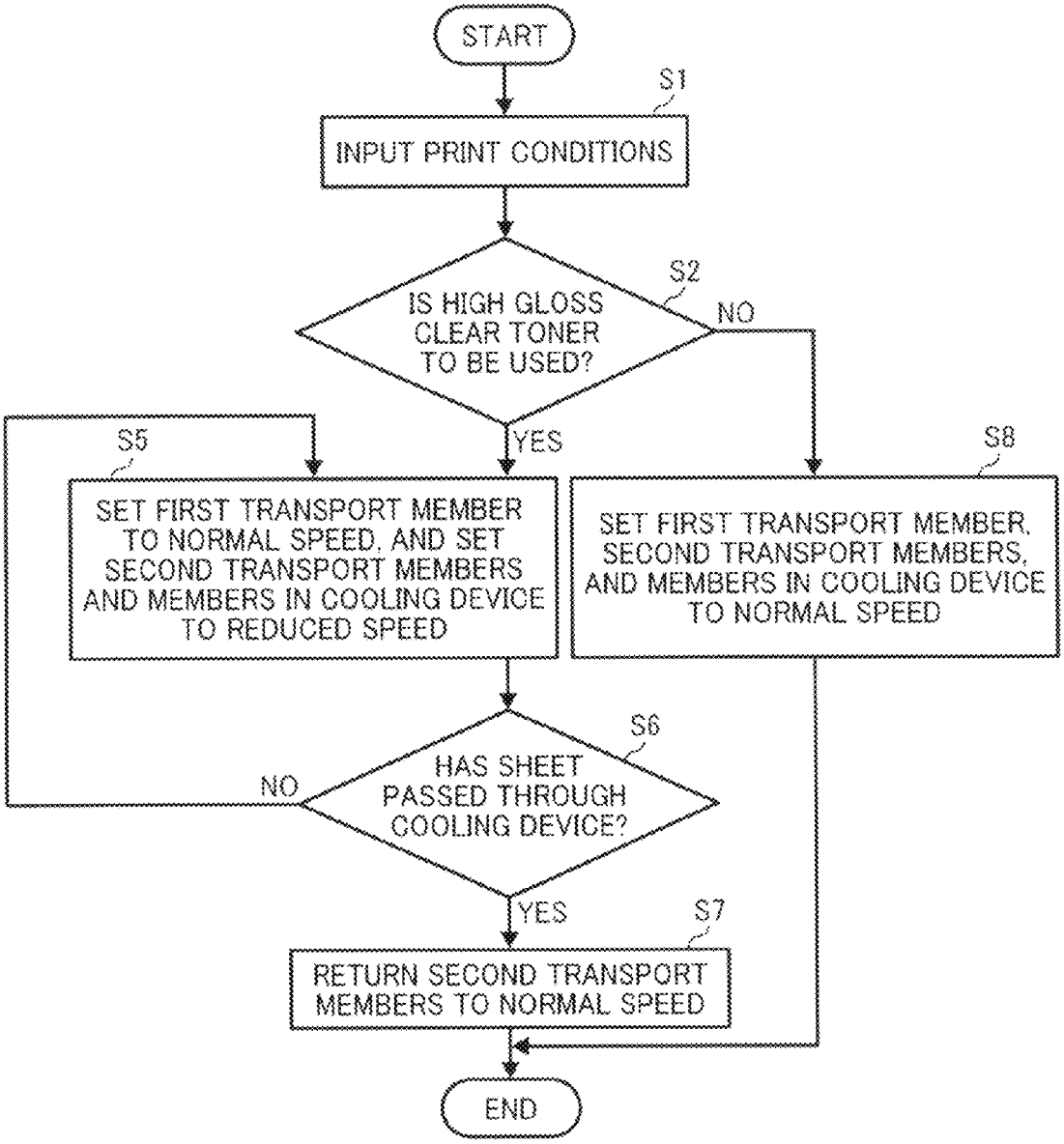
FIG. 11 is a flowchart of a cooling power control for controlling the cooling power of a cooling device according to the third example.

FIG. 11 is a flowchart of a cooling power control for controlling the cooling power of the cooling device 18" according to the third example. The user first inputs print conditions (step S1). In this step, the user specifies whether or not to use the high gloss clear toner in the printing. Then, the control unit 10 determines whether or not the high gloss clear toner is to be used based on the user information (step S2). If the use of the high gloss clear toner has been specified (YES at step S2), the control unit 10 sets a mode for reducing the transport speed of the sheet P. The control unit 10 controls the first transport member 20 to maintain a rotation speed equal to the normal speed V to transport the sheet P at the normal speed V until the sheet P passes through the fixing unit 15. The control unit 10 also previously controls the heat pipe 181 and the transport belt 184 of the cooling device 18" to rotate at a rotation speed equal to the reduced speed V' to reduce the transport speed of the sheet P below the normal speed V when the sheet P arrives at the cooling device 18". The control unit 10 further previously controls the second transport members 19 to rotate at a rotation speed equal to the reduced speed V' (step S5). Thereby, the cooling time of the sheet P in the cooling device 18" is extended, increasing the cooling power.

The reduction of the transport speed of the sheet P passing through the cooling device 18" raises a concern that the next sheet P may catch up with the preceding sheet P, causing the sheets P to overlap. With the range of the reduced speed V' specified to satisfy the condition of the foregoing expression (2), however, the sheets P are prevented from overlapping. Then, the control unit 10 determines whether or not the trailing end of the sheet P has passed through the cooling device 18" (step S6). If the trailing end of the sheet P has not passed through the cooling device 18" (NO at step S6), the control unit 10 continues the control of step S5. If the trailing end of the sheet P has passed through the cooling device 18" (YES at step S6), the control unit 10 causes the second transport members 19 rotated at the rotation speed equal to the reduced speed V' to return to a rotation speed equal to the normal speed V (step S7). Thereby, productivity is maintained while the cooling power is increased.

Meanwhile, if the user has specified non-use of the high gloss clear toner (NO at step S2), the control unit 10 sets a mode for not changing the transport speed of the sheet P (step S8). That is, the control unit 10 causes the first transport member 20, the cooling device 18", and the second transport members 19 to transport the sheet P at the normal speed V. Thereby, the first print time (i.e., the time from the receipt of a print request to the output of the first print) is maintained when the high gloss clear toner is not used.

The present inventors have examined conditions allowing an electrophotographic image forming apparatus to provide an image with a high level of gloss, such as the gloss of a film photo or a varnished image, by using a clear toner, and found conditions of viscoelastic characteristics at the fixing temperature to be satisfied by a high gloss clear toner capable of providing the high level of gloss. The high gloss clear toner, however, has an issue that the high-temperature high gloss clear toner on the recording medium immediately after the fixing process has higher adhesiveness (i.e., tackiness) than at normal temperature, and thus is likely to be offset to a transport member when coming into contact with the transport member. Further, the high gloss clear toner after the fixing process is higher in adhesiveness (i.e., tackiness) and is more likely to be offset than the process color toners owing to the viscoelastic characteristics of the high gloss clear toner. In the image forming apparatus employing the high gloss clear toner, therefore, the high gloss clear toner is likely to be offset and stuck to the transport member, forming scratches in later-formed images.

To address this issue, some typical image forming apparatuses include a cooling device that cools the toner after the fixing process to reduce the adhesiveness of the toner. Such image forming apparatuses, however, normally employ the process color toners only, and the cooling device of such image forming apparatuses is intended to cool the process color toners and has difficulty in rapidly cooling the high gloss clear toner after the fixing process to a temperature at which the adhesiveness of the high gloss clear toner is low enough to prevent the toner offset.

By contrast, an image forming apparatus according to an embodiment of this disclosure is capable of providing an image with a high level of gloss without forming a scratch in the image.

The above description is illustrative, and this disclosure has specific effects for the following aspects.

According to a first aspect, an image forming apparatus includes a color toner image forming device (e.g., the image forming units 120C, 120M, 120Y, and 120K), a fixing device (e.g., the fixing unit 15), a cooling device (e.g., the cooling device 18), a colorless toner image forming device (e.g., the image forming unit 120T), and a control device (e.g., the control unit 10).

The color toner image forming device forms a toner image on a recording medium (e.g., the sheet P) with a color toner (e.g., the process color toners of the cyan, magenta, yellow, and black colors). The fixing device heats the toner image on the recording medium to fix the toner image on the recording medium. The cooling device cools the fixed toner image. The colorless toner image forming device forms a toner image on the recording medium with a colorless toner (e.g., the high gloss clear toner) having a storage elastic modulus of 100 or less and a loss tangent of 10 or greater at a heating temperature of the fixing device. The control device controls cooling power of the cooling device based on whether or not the colorless toner image forming device forms the toner image.

In the first aspect, the colorless toner image forming device for forming the toner image with the colorless toner having the above-described characteristics is provided to provide a high level of gloss to a color toner image. As to the high gloss clear toner serving as the colorless toner that provides the high level of gloss to the color toner image, the present inventors have found from extensive studies that the high gloss clear toner needs to have viscoelasticity of a storage elastic modulus G' of 100 or less and a loss tangent tan δ of 10 or greater at a set fixing temperature. When the toner thermally fused in the fixing device has viscoelasticity satisfying the above-described conditions, the spreadability of the toner is improved. As a result, the spread toner is likely to cover a base surface, thereby smoothing the base surface and providing a favorable gloss.

In the high gloss clear toner having the above-described characteristics, however, a high-temperature portion of the high gloss clear toner immediately after the fixing process is higher in adhesiveness than the color toner, and thus is likely to be offset to, for example, a transport member for transporting the recording medium when the high gloss clear toner comes into contact with the transport member. To prevent the offset of the high gloss clear toner, the high gloss clear toner needs to be sufficiently cooled after the fixing process, and thus requires higher cooling power than the color toner.

According to an embodiment of this disclosure, the cooling power of the cooling device is controllable based on whether or not the toner image is formed with the high gloss clear toner. Specifically, if the toner image is formed with the high gloss clear toner, the cooling power of the cooling device is increased to sufficiently cool the toner image and thereby reduce the adhesiveness of the toner. Even if the toner image formed with the high gloss clear toner comes into contact with, for example, a transport member downstream of the fixing device in the recording medium transport direction, therefore, the offset of the high gloss clear toner to the transport member is minimized, thereby minimizing scratches on images formed thereafter.

According to a second aspect, in the image forming apparatus according to the first aspect, the control device controls the cooling power of the cooling device by increasing the cooling power of the cooling device when the colorless toner image forming device forms the toner image and not increasing the cooling power of the cooling device when the colorless toner image forming device does not form the toner image. With this configuration, it is possible to sufficiently cool the toner image of the high gloss clear toner, thereby reducing the adhesiveness of the high gloss clear toner and minimizing the offset of the high gloss clear toner to the transport member or the like, as described above in the foregoing embodiment. Further, since there is no increase of the cooling power of the cooling device when the colorless toner image forming device does not form the toner image, the present configuration is superior to a configuration that constantly maintains high cooling power in terms of energy conservation or productivity of the image forming apparatus.

According to a third aspect, in the image forming apparatus according to the second aspect, when the colorless toner image forming device forms the toner image, the control device increases the cooling power of the cooling device to reduce the temperature of the toner image to be equal to or lower than an offset resistance critical temperature. With this configuration, it is possible to minimize the offset of the high gloss clear toner, as described above in the foregoing embodiment.

According to a fourth aspect, in the image forming apparatus according to the third aspect, the offset resistance critical temperature is obtained based on a tape peel test. With this configuration, it is possible to obtain a toner temperature not causing the offset of the high gloss clear toner, thereby allowing a control capable of minimizing the offset, as described above in the foregoing embodiment.

According to a fifth aspect, in the image forming apparatus according to one of the first to fourth aspects, the colorless toner employed in the colorless toner image forming device is an oilless fixing toner. With this configuration, it is possible to configure the fixing device as an oilless mechanism, which is simple in configuration, as described above in the foregoing embodiment.

According to a sixth aspect, in the image forming apparatus according to one of the first to fifth aspects, the cooling device includes a contact-type cooling unit (e.g., the heat pipe 181)

that directly contacts and cools the toner image on the recording medium. With this configuration having the contact-type cooling unit that directly contacts and cools the toner image (e.g., the toner image T), it is possible to obtain high cooling power.

According to a seventh aspect, in the image forming apparatus according to the sixth aspect, the cooling device further includes an auxiliary cooling unit (i.e., the fan 182) that assists the cooling of the toner image by the contact-type cooling unit, and the control device changes the cooling power of the contact-type cooling unit by using the auxiliary cooling unit. With this configuration, it is possible to easily control the cooling power of the contact-type cooling unit (e.g., the heat pipe 181) by changing the volume of air blown to the contact-type cooling unit (e.g., the heat pipe 181) by the auxiliary cooling unit (i.e., the fan 182), as described above in the foregoing first example.

According to an eighth aspect, in the image forming apparatus according to the seventh aspect, the auxiliary cooling unit is disposed to cool a rear surface of the recording medium being transported while in contact with the contact-type cooling unit. With this configuration, it is possible to more effectively cool the toner image, as described above in the foregoing second example.

According to a ninth aspect, in the image forming apparatus according to one of the first to eighth aspects, the control device changes the transport speed of the recording medium when the recording medium is transported through the cooling device to change the cooling power of the cooling device. With this configuration, it is possible to increase the cooling power with a simple configuration that obtains a sufficient cooling time by extending the time of contact between the recording medium and the cooling device, as described above in the foregoing third example.

According to a tenth aspect, in the image forming apparatus according to the ninth aspect, the control device changes the transport speed of the recording medium at a position downstream of the fixing device in the recording medium transport direction. With this configuration, it is possible to maintain overall productivity of the image forming apparatus even with the change of the transport speed of the recording medium for increasing the cooling power, as described above in the foregoing third example.

According to an eleventh aspect, in the image forming apparatus according to the ninth or tenth aspect, the change of the transport speed of the recording medium satisfies a relationship $V>V'>B/(A+B)\times V$ in which V represents a normal speed for transporting the recording medium when the colorless toner image forming device does not form the toner image, V' represents a reduced speed for transporting the recording medium when the colorless toner image forming device forms the toner image, A represents the length of a space between adjacent recording media located upstream of the fixing device in the recording medium transport direction, and B represents the length of each of the recording media in the recording medium transport direction. The reduction of the transport speed of the recording medium (e.g., the preceding sheet P) being transported through the cooling device (e.g., the cooling device 18") raises concern that the next recording medium (e.g., the next sheet P) may catch up with the preceding recording medium (e.g., the preceding sheet P), causing transport of the recording media in an overlapped manner. With the above-described condition satisfied, however, it is possible to prevent the transport of the recording media in an overlapped manner.

According to a twelfth aspect, in the image forming apparatus according to one of the first to eleventh aspects, the control device determines whether or not the colorless toner image forming device forms the toner image based on an input user setting item. This configuration is simple and low in cost, not requiring a special sensor for making the above-described determination.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, this disclosure may be practiced otherwise than as specifically described herein.

What is claimed is:

1. An image forming apparatus comprising:

a color toner image forming device to form a toner image on a recording medium with a color toner;

a fixing device to heat the toner image on the recording medium to fix the toner image on the recording medium;

a cooling device to cool the fixed toner image;

a colorless toner image forming device to form a toner image on the recording medium with a colorless toner having a storage elastic modulus of 100 or less and a loss tangent of 10 or greater at a heating temperature of the fixing device; and a control device to control cooling power of the cooling device based on whether or not the colorless toner image forming device forms the toner image.

2. The image forming apparatus according to claim 1, wherein the control device controls the cooling power of the cooling device by increasing the cooling power of the cooling device when the colorless toner image forming device forms the toner image and not increasing the cooling power of the cooling device when the colorless toner image forming device does not form the toner image.

3. The image forming apparatus according to claim 2, wherein, when the colorless toner image forming device forms the toner image, the control device increases the cooling power of the cooling device to reduce a temperature of the toner image to be equal to or lower than an offset resistance critical temperature.

4. The image forming apparatus according to claim 3, wherein the offset resistance critical temperature is obtained by a tape peel test.

5. The image forming apparatus according to claim 1, wherein the colorless toner employed in the colorless toner image forming device is an oilless fixing toner.

6. The image forming apparatus according to claim 1, wherein the cooling device includes a contact-type cooling unit that directly contacts and cools the toner image on the recording medium.

7. The image forming apparatus according to claim 6, wherein the cooling device further includes an auxiliary cooling unit that assists the cooling of the toner image by the contact-type cooling unit, and wherein the control device changes cooling power of the contact-type cooling unit by using the auxiliary cooling unit.

8. The image forming apparatus according to claim 7, wherein the auxiliary cooling unit is disposed to cool a rear surface of the recording medium being transported while in contact with the contact-type cooling unit.

9. The image forming apparatus according to claim 1, wherein the control device changes a transport speed of the recording medium when the recording medium is transported through the cooling device to change the cooling power of the cooling device.

10. The image forming apparatus according to claim 9, wherein the control device changes the transport speed of the recording medium at a position downstream of the fixing device in a recording medium transport direction.

11. The image forming apparatus according to claim 9, wherein the change of the transport speed of the recording medium satisfies a relationship $V>V'>B/(A+B)\times V$ in which V represents a normal speed for transporting the recording medium when the colorless toner image forming device does not form the toner image, V' represents a reduced speed for transporting the recording medium when the colorless toner image forming device forms the toner image, A represents a length of a space between adjacent recording media located upstream of the fixing device in a recording medium transport direction, and B represents a length of each of the recording media in the recording medium transport direction.

12. The image forming apparatus according to claim 1, wherein the control device determines whether or not the colorless toner image forming device forms the toner image based on input setting.

* * * * *